United States Patent [19]

Seydel et al.

[11] Patent Number: 4,641,404

[45] Date of Patent: Feb. 10, 1987

[54] POROUS WARP SIZING APPARATUS

[76] Inventors: Scott O. Seydel; William D. Letbetter, both of 80 Broad St., NW., Atlanta, Ga. 30303; William H. Cutts, P.O. Box 748, Clemson, S.C. 29631

[21] Appl. No.: 727,867

[22] Filed: Apr. 26, 1985

Related U.S. Application Data

[63] Continuation-in-part of Ser. No. 308,449, Oct. 5, 1981, Pat. No. 4,513,485.

[51] Int. Cl.[4] ..... D02H 5/02

[52] U.S. Cl. ..... 28/178; 28/179; 28/186; 118/234; 118/259

[58] Field of Search ..... 28/178, 179, 180, 181, 28/186; 118/234, 259

[56] References Cited

U.S. PATENT DOCUMENTS

| | | | |
|---|---|---|---|
| 2,194,937 | 3/1940 | Hawkins | 28/179 |
| 2,402,652 | 6/1946 | Martin | 28/179 |
| 3,280,441 | 10/1966 | Cocker, III | 28/179 |
| 4,364,157 | 12/1982 | Cutts | 28/179 |

OTHER PUBLICATIONS

Cutts et al., "Development of a New Method for the Application of Warp Sizing" The World Conference of Sizing, Part Two, pp. 24–41, Clemson University, Mar. 24–28, 1982.

Seydel, "The State of the Art in Warp Sizing" America Textiles, pp. 20, 24, 50 (Mar. 1984).

*Primary Examiner*—Robert R. Mackey
*Attorney, Agent, or Firm*—Cort Flint

[57] ABSTRACT

An apparatus and method for sizing warp yarn utilized in preparing a loom beam for weaving are disclosed. A porous application roll (A) is utilized for applying a sizing material onto a sheet of warp yarns (12) passing between a pressure roll (30) and the application roll. The application roll includes a continuous cylindrical porous application surface (B) formed around the entire periphery of the roll having an extent at least as great as the warp yarn sheet width. An intermediate porous distribution layer (C) is provided next to the application surface (B) for disbursing the sizing material onto the application surface. A porous flow control membrane (D) having a pore size less than that of the distribution layer occupies a boundary region for metering the sizing material. When the passage of warp yarns is discontinued, the application roll (A) is moved to an idle position by an actuator (38). In the idle position, liquid (72) is made to contact the application surface to maintain it in a moist condition. A wiper blade (80) is utilized to remove excess liquid. The excess liquid is removed before the application roll again is used to apply sizing material, so that the sizing material is not diluted.

17 Claims, 14 Drawing Figures

POROUS WARP SIZING APPARATUS

CROSS REFERENCE TO RELATED APPLICATION

This application is a continuation-in-part of application Ser. No. 308,449 of Oct. 5, 1981, now U.S. Pat. No. 4,513,485 granted on Apr. 30, 1985.

BACKGROUND OF THE INVENTION

In the process of preparing a warp loom beam for weaving, warp yarns are delivered through a slasher apparatus which includes a size box which applies a protective coating of size to the yarns. The size holds the yarns together during weaving and prevents the threads from being chafed.

Water is typically used as the dissolving medium in which the size is dissolved and disbursed to aid in uniform application to the warp yarns. A ten percent add-on weight of size is a commonly acceptable amount, and a ten percent solution of solids (size) and ninety percent water is normally utilized. This requires that a considerable amount of water be squeezed and dried out of the yarns for every pound of size that is applied to the yarns.

Conventional size boxes include an immersion roll which is immersed in a sizing material in the size box. The warp yarns pass under the immersion roll and then between a pair of pressure rolls where some of the excess size is squeezed out. However, considerable water remains to be removed and dried out of the yarns after application of the size.

In an attempt to eliminate the application of excessive water to the yarns which thereafter must be removed by drying, requiring considerable amounts of energy, a method is proposed in U.S. Pat. No. 4,364,157 of applying only a very small, metered amount of concentrated size solution to the yarns. In this method, the yarns do not become immersed in the size material, but rather pass between an application roll and a pressure roll. A metered amount of sized is applied to the outside of the application roll which is pressed into the yarns at the nip of the rolls. The application roll is partially immersed in the size material in the size box, but the excess size is removed by a doctoring or other means before the size is applied to the warp yarns. In this method, a metered amount of sizing material is applied without a sacrifice in the strength of the warp yarns.

While various porous, engraved, etched, and grooved rolls have been utilized heretofore, as simple application rolls for applying fluid to yarns and strands, these have generally not been utilized in size boxes or the metering of size, apparently due to the inherent problems occurring in the adhesive and chemical nature of the size. Examples of such rolls are shown in U.S. Pat. Nos. 3,306,254; 3,157,536; 3,553,006; 4,268,550; and British Pat. No. 23,955, many of which are related to single strand fluid treatment.

In British Pat. No. 742,308, a device for dry sizing of threads is disclosed which includes a rotating sieve roll to which a batch of threads are brought into contact. A dry size, containing no water, is applied through a perforated jacket and an outer brush-like covering. The method and apparatus thus differ from the conventional application of a wet size with water utilizing an application and pressure roll. The control of the amount and nature of the size coating applied by the British device would not be satisfactory and exact for use in modern slashing processes.

While the metering of the sizing material on the outside of the roll as disclosed in U.S. Pat. No. 4,364,157 is an entirely suitable process, the precision machining of the doctoring blade and roll surface involve a good deal of expense and skill in order to provide the required precise metering effect. Varying the amount of the metered size during the sizing process such as for different warp styles becomes difficult, often requiring change out of the application roll in the case of a patterned roll.

Accordingly an important object of the present invention is to provide an apparatus and method for applying size to warp yarns wherein a metered amount of size is applied to the warp yarns.

Still another important object of the present invention is to provide an apparatus and method for applying size to warp yarns in a metered amount wherein the size material is applied from the inside of an application roll outwards to an exterior application surface of the roll, thus simplifying many problems of applying size material in metered amounts.

Still another important object of the present invention is to provide an apparatus and method for varying, in a controlled manner and over a given range continuously during the sizing process, the amount of the metered size to be applied to warp yarns such that different warp styles requiring different size add-on values can be prepared with the same applicator roll.

Still another important object of the present invention is to provide an apparatus and method for applying a size material in a highly precise metered amount with a porous metering and application roll which is maintained moist regardless of the delivery of size therethrough.

Still another important object of the present invention is to provide a method and apparatus for applying a metered amount of size to warp yarns during a slashing process wherein an application roll having layers of different porosity is utilized to control the metering and distribution of the size material onto the yarns.

SUMMARY OF THE INVENTION

The above objectives are accomplished according to the present invention by providing an apparatus and method wherein a pressure roll and an application roll having a hollow interior and an outer porous application surface are provided. The application roll is biased against the pressure roll to define a nip through which the warp yarns pass for application of a sizing material. There is a porous cylindrical distribution layer next adjacent the porous application surface. A porous flow control membrane layer (or boundary region) is formed adjacent to the inside surface of the distribution layer which meters a desired amount of sizing material. By delivering sizing material to the interior of the hollow application roll at desired application volumes and pressures, the amount of sizing material metered onto the application surface can be precisely controlled. An actuator is provided for moving the application roll between an application position in which sizing material is applied to the yarns, an idle position in which the application roll is out of contact with the pressure roll and the warp yarns, and a neutral position therebetween. The application roll is moved to the neutral or idle position while the passage of warp yarns through the size box is stopped. The application surface of the application roll is maintained in a moist condition by contacting the application surface with a liquid or damp surface while the application roll is in the idle position. The sizing material remaining on the surface and in the pores of the distribution layer and within the flow control membrane are prevented from drying out. Upon resumption of operation of the size box, excess liquid is removed from the application surface prior to contacting the warp yarns so that the sizing material is not diluted when applied again to the warp yarns.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

Figure 3:
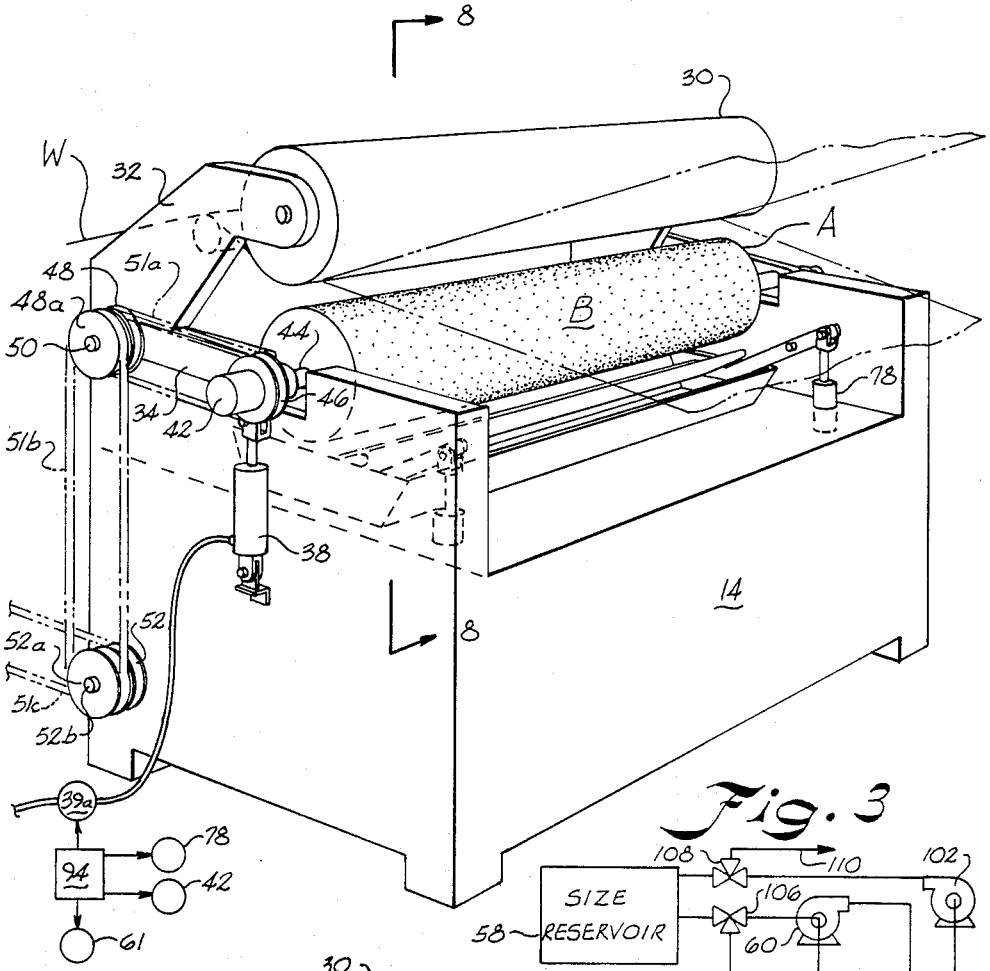
FIG. 3 is a perspective view illustrating the apparatus and method for sizing warp yarns according to the present invention.
Figure 9:
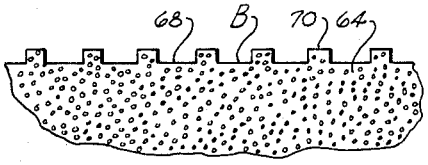
Figure 10:
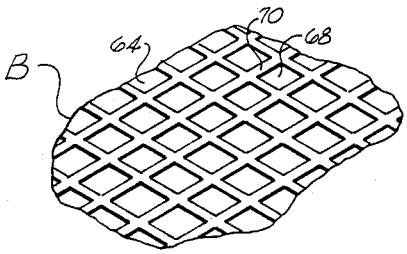
Figure 8:
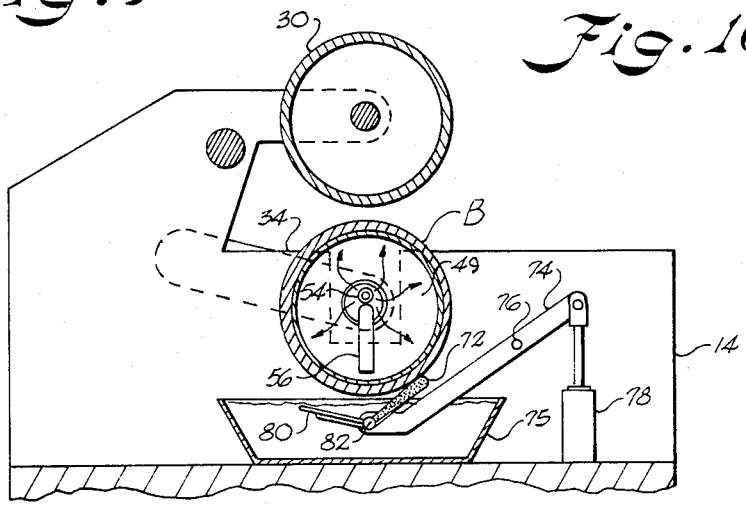
Figure 11:
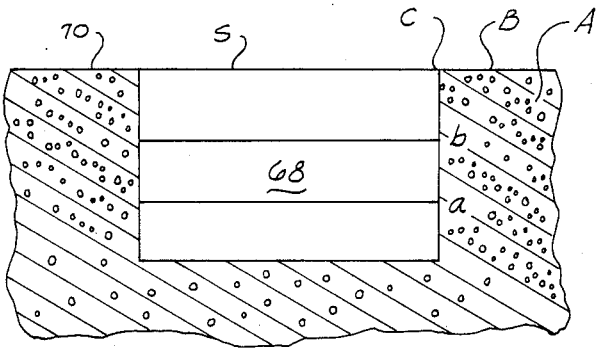
Figure 12:
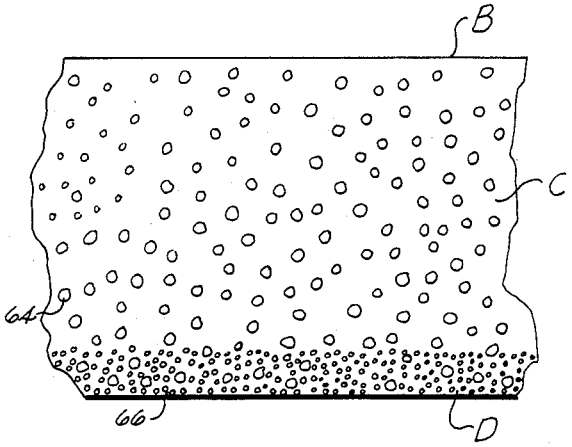

FIGS. *7a–7c* are schematic views illustrating the apparatus and method of the present invention wherein the application roll is illustrated in an application position and an idle position;

FIG. 8 is a sectional view taken along line 8—8 of FIG. 3;

FIG. 9 is an elevation illustrating an alternate embodiment of a porous applicator roll constructed according to the present invention having an engraved application surface;

FIG. 10 is a top plan view of a patterned roll constructed according to the invention;

FIG. 11 is a cross-section schematic view illustrating the concept of a variably filled cell of a patterned roll according to the invention; and FIG. 12 is a schematic view of the layers or boundary regions of a porous flow control size application roll constructed according to the invention.

DESCRIPTION OF A PREFERRED EMBODIMENT

Figure 1:
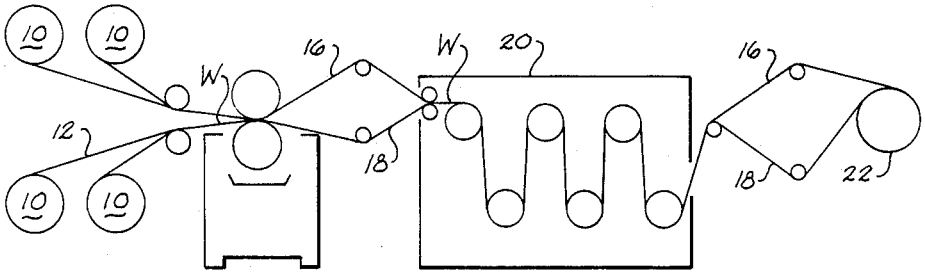
FIG. 1 is a schematic view illustrating a slashing process incorporating an apparatus and method for applying size to the warp yarns in preparation of a warp loom beam according to the invention.

Referring now in more detail to the drawings, a slashing process for preparing a loom beam is illustrated schematically in FIG. 1 which includes a plurality of warp section beams 10 from which a plurality of individual warp yarns 12 are withdrawn. The individual warp yarns 12 are arranged generally side by side in a sheet W prior to passing through a size box 14 in which a coating of sizing material is applied to the warp yarns. Emerging from the size box 14 the warp yarn sheet is split into two or more sheets 16 and 18 so that adjacent warp yarns do not stick together. Typically, the plurality of warp sheets are formed into the single warp sheet W for passage through a dryer 20 before being busted into a plurality of warp sheets 16 and 18 prior to being wound upon a loom beam roll 22 on which the individual warp yarns are wound side by side in a parallel manner. The loom beam is then carried to a loom for weaving.

Figure 2:
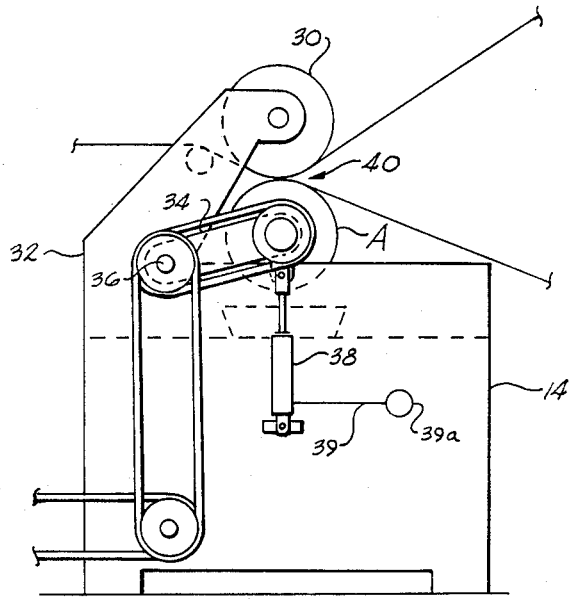
FIG. 2 is an elevation view illustrating a size box incorporating the apparatus and method of the present invention.

Referring now in more detail to the present invention, FIG. 2 illustrates a size box 14 constructed in accordance with the present invention wherein an upper pressure roll 30 is carried by a box frame 32. A lower application roll A is carried by the frame having a unique construction in accordance with the apparatus and method of the present invention. The application roll is pivotally mounted to the box frame 32 by a lever arm 34 pivoted at 36. While the box 14 is referred to as a size box, this is not to be understood as referring to a conventional size box. In a conventional size box there is a reservoir in which the application roll and warp yarns are immersed. This is not the case in the present invention.

The actuator means for moving the application roll between an application position, neutral position, and an idle position (FIGS. *7a–7c*) is shown in the form of a hydraulic or air cylinder 38 connected to a suitable fluid source via lines 39. A conventional pneumatic control valve 39*a* is utilized to manually or automatically control the hydraulic actuator and the position of the actuator and roll. In the application position, the application roll is in contact with the pressure roll 30 to define a nip 40 between which the warp yarn sheet W passes for application of size. The means and method in which the size is applied will be more fully described hereinafter. In the idle position, the application roll contacts a surface conditioning means. The neutral position is a position for the roll intermediate the application and idle position.

Figure 4:
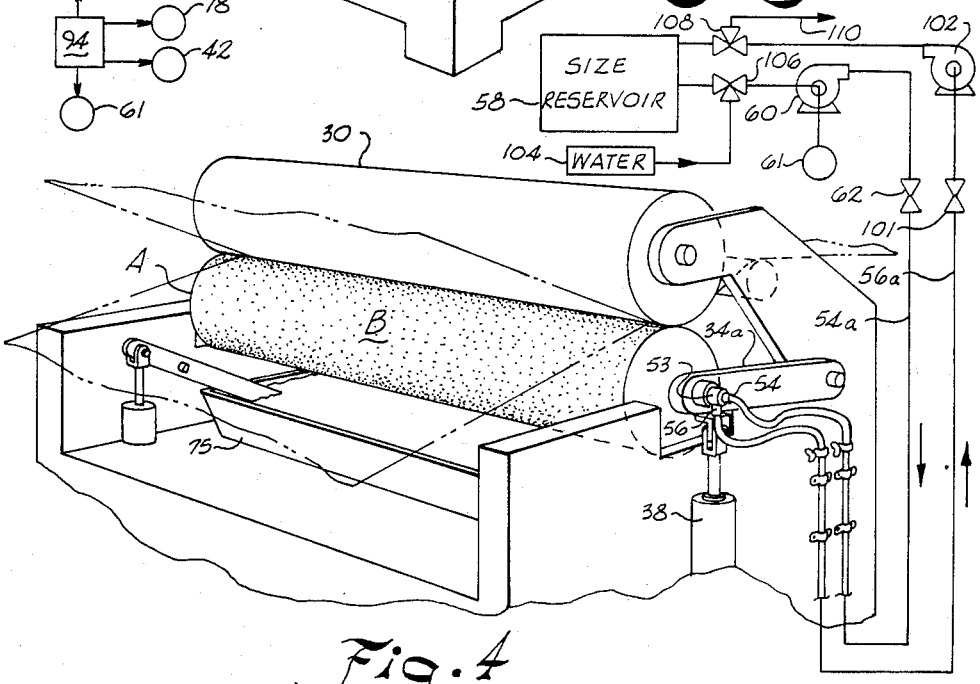
FIG. 4 is a perspective view illustrating the apparatus and method of the present invention.

Referring now to FIGS. 3 and 4, the apparatus and method will be described in more detail. As can be seen in FIG. 3, an idler motor 42 is attached to a shaft 44 of the roll and provides an auxiliary drive for the application roll A. The shaft 44 of the application roll has a main drive which includes a pulley wheel 46 affixed to the shaft 44. There is a second pulley wheel 48 and a third pulley wheel 48*a* carried on a shaft 50 journaled in the frame which forms the pivot for the lever 34. A fourth pulley wheel 52 and a fifth pulley wheel 52*a* are rotatably carried on a shaft 52*b* journaled on the frame. A drive belt 51*a* is connected between pulley wheels 46 and 48. A drive belt 51*b* is connected between pulley wheels 48*a* and 52*a*. A drive belt 51*c* is connected to the pulley wheel 52 and to the drive of the slashing machine in a conventional manner. Through this drive arrangement, the application roll A is driven in response to slasher operation in a conventional manner as the warp sheet W passes through the slashing machine. Chain and sprocket drives may be interchangeably utilized in the main drive.

Figure 6:
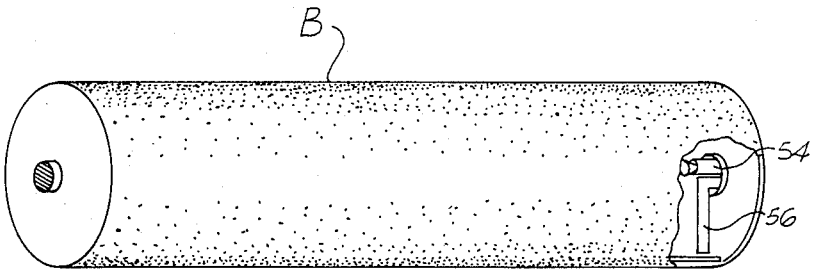
FIG. 6 is a perspective view illustrating a porous application roll constructed in accordance with the apparatus and method of the present invention.

Referring now to FIGS. 6, 8, and 12, the application roll A will be described in more detail. The diameter of the application roll A is preferably in the range of 3 to 6 inches. There is an exterior application surface B formed on the roll which is continuous and coextends over the entire cylindrical shape of roll A. The application surface covers the entire circumference and length of the application roll. In this manner, an application surface is presented which is at least as great as the width of the warp yarn sheet W passing over the roll and continuous to accept all of the individual warp yarn ends, regardless of denier, across the width of the warp yarn sheet. Next adjacent to the porous application surface B is a porous cylindrical distribution layer C. The porous distribution layer C is a continuous cylindrical layer. Next adjacent to the interior boundary limits of the porous distribution layer is a porous membrane region D formed as a formed-in-place membrane coating over the entire interior surface of the distribution layer C. The porous membrane D provides a flow control means for metering the flow of sizing material onto the application surface following its delivery into the interior 49 of the hollow application roll in a manner which will be more fully hereinafter described. Other details of a suitable porous roll may be had by reference to the above, of which this application is a continuation-in-part. Having been taught the expedients of the present invention, the provisions of such a roll to pass and meter a sizing material such as polyvinyl alcohol would be well within the purview of one skilled in the art. A suitable porous construction is available from Carre, Inc. of Seneca, S.C.

The roll may be visualized as a sealed hollow cylinder, or tube, whose walls are composed of stainless steel powder (normally 5 micron diameter particles) which has been pressed very compactly together and then sintered, or fused, in a high temperature oven. The steel particles fuse together where they contact each other but maintain enough integrity to preserve the interstices between particles. Thus is produced a seemingly solid steel-walled tube, but with very finely porous walls. The tube ends are sealed with solid metal and plates and hollow journals (having appropriate egress and exit conduits and drain plugs and described more fully hereinafter) and provided with whatever surface pattern engraving might be appropriate to provide a suitable size applicator roll. While a porous layered roll generally described above has been proposed for a hyperfiltration element in U.S. Pat. No. 4,200,533, incorporated herein by reference, its use as a metering roll for textile applications has not been heretofore proposed except in the above-referenced patent application related to oiling a lease rod to prevent sticking.

Common mechanical engraving procedures may destroy the porosity of the roll and it is preferred that special single-point machinery techniques followed by etching, or etching techniques by themselves, or special electronic engraving techniques, as are well known in the art, will be used to produce any appropriate surface patterns on the applicator roll.

Referring to FIG. 4, there is a rotary union 53 carried by a lever 34*a*. The rotary union 53 forms an end shaft for the application roll A on an end thereof remote from the shaft 44. As can best be seen in FIGS. 6 and 8, the rotary union includes an entrance conduit 54 and a return conduit 56. There is a size reservoir 58 which contains a source of a suitable sizing material. There is a pump 60 which delivers sizing material by way of a conventional two-way valve 62 to the inlet conduit 54. The pump 60 may be any suitable metering pump such as a conventional variable displacement pump automatically controlled by a controller 61 in response to the slasher operation to provide sizing material delivered to the interior 49 of the hollow application roll at a predetermined volume which is proportional to slasher speed. The ensuing pressure will be determined by the pore dimensions of the flow control membrane and the physical chemical characteristics of the size material to be passed through it into porous distribution layer C as the desired amount of sizing material is metered onto the application surface B.

The pore size of the porous material 64 (e.g. 1–5 microns) of the porous distribution layer C will generally be greater than the effective pore size of the formed-in-place porous flow control membrane material 66 (e.g. 100 angstroms). In this manner, the flow control membrane will control the flow of sizing material which is then evenly disbursed and distributed throughout the porous layer C and onto the application surface B. This porous distribution layer serves to equalibrate the distribution of size in the lateral dimensions of the applicator roll prior to its emergence onto the application surface B, thus providing a homogeneous distribution of size presenting equal amounts of material to each of the yarn ends contacting the surface. The porous application surface may be simply the unadulterated outer surface of the porous distribution layer C. In this case, the application surface B will have a pattern of surface pore sizes the same as that within the distribution layer C. This will constitute the finest-grained engraved state of the application roll.

The application surface B may also have a different pore or cellular pattern than the porous distribution layer C. The application roll may be physically engraved with a quadrangular, pyramidial, or trihelical pattern, or any other pattern of grooves or cells that might be called for to serve as a coarser-grained engraved state to collect and hold larger volumes of sizing material or other chemicals to be applied compared to the limited amounts contained in the distribution layer alone. FIG. 9 represents such an engraved application surface wherein diamond-shaped cells 68 are formed with alternating raised lands 70 between the cells. The bottom of the cells will be comprised of the porous material 64 of the distribution layer C.

FIG. 10 shows a plan view of a patterned surface treatment of the applicator roll. The depressions, or cells, in the surface are indicated by 68 while the land areas of the pattern are indicated at 70. This would describe one of the coarser surface patterns wherein the roll surface could be said to have an engraved volume of some amount which is usually described in units of cubic billion millimicrons per square inch of roll surface. The finest-grained case can be visualized similarly except that the cells have only the dimensions of the interstices between the sintered stainless steel powder particles comprising the applicator roll walls. FIG. 11 shows one of the cells 68 of FIG. 10 which might be filled with size solution at three different levels corresponding to three progressively increasing volumes at c, b and a, respectively. The clear advantage of combining a surface pattern with the porous nature of the roll through which size is delivered from the inside to the outer surface, is that any predetermined volume of size material can be metered at a prescribed rate by the metering pump system to achieve whatever add-on is desired for a particular warp of yarn. By simply adjusting the metering rate, the size material can be presented from a single applicator roll in amounts ranging from "small" to "large," allowing a single roll to be used to achieve the desired add-on of size on a wide range of styles without changing to a new applicator roll for each new style.

Figure 5:
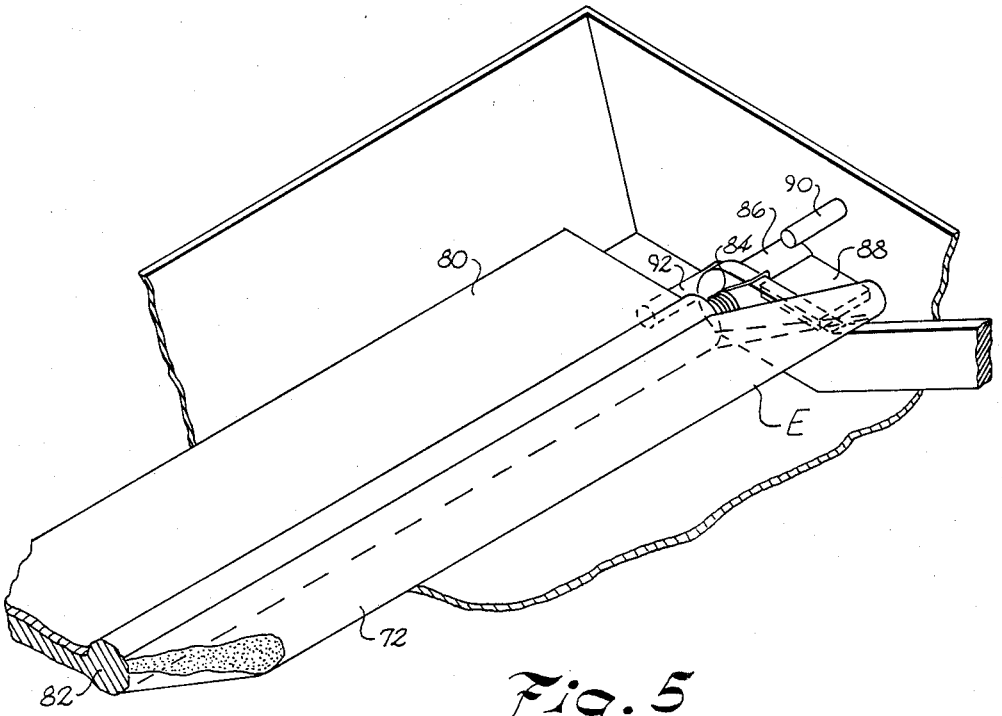
FIG. 5 is a partial perspective view illustrating a surface conditioning device constructed according to the invention.

During the cessation of the passage of the warp yarns through the sizing process and machine 14, it is generally necessary to stop the delivery of sizing material to the application roll. During cessation, delivery of sizing material onto the application surface is not desired. In order that the application roll does not dry out during cessation of the slasher and warp yarn passage, surface conditioning means E for maintaining the application surface in a moist condition is provided. In the idle position, the application roll A is moved downwards so that it is out of contact with the warp yarn sheets and the pressure roll. In accordance with the illustrated embodiment, as can best be seen in FIGS. 5 and 8, the application surface B of the application roll is contacted by a liquid contact means in the form of an elongated sponge or wick applicator 72 which conditions the surface. There is provided a reservoir 75 in which the sponge or wick is immersed. The elongated applicator 72 is carried by a pair of lever arms 74 pivoted at 76 to the size box 14. Hydraulic actuators 78 move the levers to bring the sponge applicator into contact with the application roll in the idle position during warp cessation (FIG. 8).

It will be noted that an elongated wiper blade 80 is affixed on a shaft 82 with the sponge applicator, with the shaft rotatably carried between lever arms 74. There is a spring 84 which biases the sponge applicator counterclockwise. A pivot actuator assembly 86 is pivotally carried by the arm 74 as can best be seen in FIG. 5. As the lever 74 is raised, an actuator flange 88 engages an abutment 90 causing a pin 92 integral with assembly 86 to engage underneath wiper blade 80 and pivot it clockwise into contact with the roll A as seen in FIG. 7*c*.

In the idle position, the idler motor 42 provides an auxiliary drive for driving the application roll at a reduced speed with the application surface C contacting the moistened sponge applicator 72. The slasher drive is disengaged so that driver wheel 46 idles. One of the pulley wheels may include a one-way ratchet so that the auxiliary drive motion is transmitted freely without affect on the main drive.

A suitable liquid level sensor (not shown) may be used to maintain the level of liquid in reservoir 58. Removal means for removing excess moisture from the application surface prior to the application roll being moved back to the application position is provided by elongated wiper 80 extending along the length of the application roll. The wiper blade 80 may be any rubber or other suitable wiping or doctoring blade for removing excess liquid from the application surface. This prevents the application of diluted sizing material to the yarns after the delivery of pressurized sizing material has once again been commenced to the application roll. The excess liquid will be removed before the application roll again contacts the warp yarns between the pressure roll and application roll. In this manner, the condition of the application surface is always maintained suitable for applying a desired amount of a concentrated sizing regardless of the intermittent operation of the slasher unit.

Figure 7A:
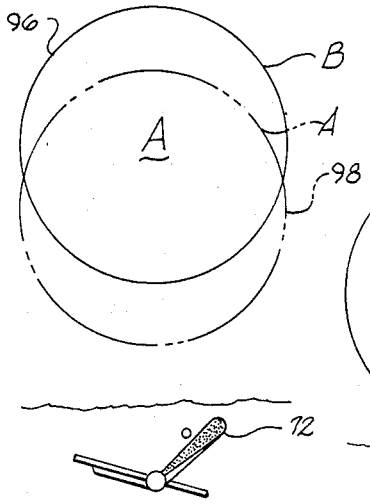
Figure 7B:
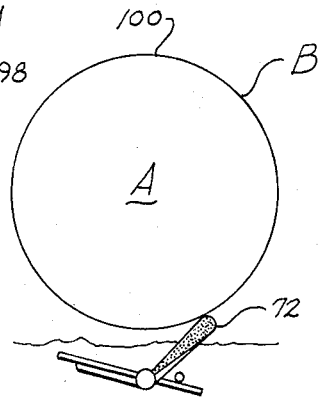
Figure 7C:
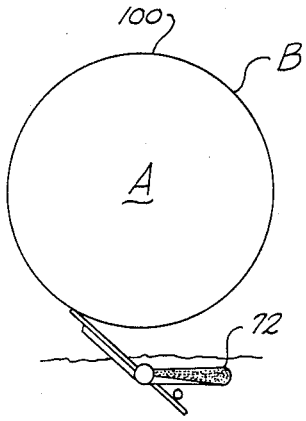

Referring now to FIGS. 7*a*, 7*b* and 7*c*, the method and apparatus will be described for maintaining the application roll A in a moist, flow-through condition when not operating. Upon cessation of warp passage, a signal will be delivered to controller 94 which will control the pneumatic valve, preferably electronically, to position actuator 38 and roll A from an application position 96 to a neutral position 98 shown by phantom line in FIG. 7*a*. If the cessation is momentary, the roll will be returned to the application position 96 as determined by a preset value and timing circuit of controller 94. However, should the cessation last beyond a predetermined time, the time period during which the size is in danger of drying in the pores of the application surface B and distribution layer C, application roll A will be dropped to the idle position 100. Simultaneously, controller 94 signals actuator 78 to bring the sponge applicator 72 into contact with the application surface B. The sponge is also partially immersed in the reservoir 74 and kept wet. Idler motor 42 rotates the application at a slow speed while the slasher drive is terminated. Prior to resumption of slasher operation, controller 94 signals actuator 78 which raises the surface conditioning means E until wiper blade 80 contacts the application surface B to remove excess liquid, as can best be seen in FIG. 7*c*. Next, the controller signals valve 39*a* to raise the application roll back to the application position 96 whereupon sizing operation resumes. Prior thereto, the resumption of size metering pump 60 is resumed.

In some instances when the slasher unit is down (for example, over the weekend), it may be desirable to empty or clean out the application roll. Size may be removed through return pipe 56 and line 56*a* via pump 102. There is provided a source of water or other rinsing liquid at 104 delivered by a conventional three-way valve 106 to the pump 60. The valve 106 cuts off the flow of sizing material from the reservoir 58 where rinse water instead is delivered. Water enters the inlet conduit 54 through line 54*a* and is returned by way of the return conduit 56 and line 56*a* through a two-way valve 101 and return pump 102. A conventional three-way valve 108 is provided which either delivers the rinse to a drain outlet 110, or returns the size to the size reservoir 58 where emptying of the application roll is being made.

In accordance with the present invention, a method is provided for applying a sizing material to warp yarns during a slashing process in preparing a loom beam for weaving. The method advantageously includes metering a precise amount of sizing material onto an exterior application surface of an application roll without the need of immersing the roll or applying the sizing material directly to the outside surface of the roll. In the present invention, a pressurized sizing material is delivered to the hollow interior of the application roll wherein it is metered and disbursed outwardly through a flow control membrane that is porous, and a porous distribution layer. The application roll is provided with a desired porous application surface which presses the metered amount of sizing material onto the warp yarns. A finely-grained porous surface may be provided which presses the sizing material uniformly into the yarns from one side, or a patterned application surface may be provided. The patterned application surface may apply the sizing material to the yarns in a predetermined pattern such as at spots along spaced intervals of the yarn. The method contemplates moving the application roll between an application position and an idle position. An intermediate neutral position may also be advantageously utilized. In the idle positon, the application roll is out of contact with the pressure roll and the warp yarns. When passage of the warp yarns stops through the slashing unit, the application roll may be moved to the idle position so that excess sizing is not applied. To prevent the sizing material from drying out in the porous material of the various layers of the roll, means are provided for maintaining the application surface in a moist condition when the application roll is in the idle position.

In accordance with the method, the application roll is contacted with a liquid dampening assembly when in the idle position to prevent dryout of the application roll and excess liquid is removed from the application roll prior to it again being returned to the application position. In this manner, the sizing material is not diluted by the excess liquid when the sizing process is resumed.

EXAMPLE

The apparatus and method allows that the appropriate size add-on and metered amount be determined and set, for example, as follows. It is desired to achieve 11.5% add-on of size solids (on the weight of the yarn) to a warp containing 5700 ends of 26/1 yarn. The weight per 1000 yards of this warp is calculated from well-known formulae which show that, $$\text{yarn weight/1000 yds} = 5700/(840 \times 26) \times 1000$$

$$= 261 \text{ lbs/1000 yds.}$$

The weight of size solids necessary to achieve 11.5% add-on to 261 lbs. of yarn is, $$\text{weight of size solids} = 11.5\% \times 261 \text{ lbs.}$$

$$= 30.02 \text{ lbs.}$$

The size liquor is a 25% solids solution, for example of polyvinyl alcohol, which weighs 8.7 lbs/gal. Therefore, only 2.175 lbs/gal (i.e., 25%) is solids. Hence, it would take 30.02/2.175=13.8023 gal. of this size liquor for each 1000 yards of warp, or 0.0138 gal. per yard of warp, to achieve the desired size add-on level. The appropriate size add-on is thus achieved by setting the metering pump to deliver 0.0138 gallons of the 25% solids size solution each time the yard counter advances 1 yard. Note that this amount of size is metered regardless of whether the yard is moving forward rapidly or slowly.

Thus it can be seen that an advantageous apparatus and method can be had according to the present invention for metering of sizing material onto warp yarns. The need to deposit the metering material onto the outside surface of the metering roll prior to application to the warp yarns is eliminated by metering the sizing material from the inside out of the application roll. A simple and inexpensive flow control membrane and pressurized delivery of sizing material to the interior of the application roll are utilized to meter a desired amount of sizing material onto the outer application surface of the application roll. By providing means for maintaining the application surface in a moist condition when the warp yarns are not being sized, a porous roll can be advantageously utilized in the sizing process.

While a preferred embodiment of the invention has been described using specific terms, such description is for illustrative purposes only, and it is to be understood that changes and variations may be made without departing from the spirit or scope of the following claims.

What we claim is:

1. Apparatus for use in preparing a loom beam on a slasher which includes apparatus for applying a sizing material to individual warp yarns arranged side by side in a warp yarn sheet prior to being wound upon said loom beam comprising:

a frame;

a pressure roll carried by said frame:

an application roll having a hollow interior carried by said frame in contact with said pressure roll to define a nip through which said warp yarn sheet passes;

a continuous cylindrical porous application surface formed on said application roll having an extent at least as great as the width of said warp yarn sheet passing between said nip of said rolls;

drive means for rotating said application roll in response to the operation of said slasher;

a continuous cylindrical porous distribution layer included in said application roll next adjacent said application surface for distributing said sizing material onto said application surface;

a continuous porous flow control membrane formed adjacent a boundary region of said continuous cylindrical distribution layer in fluid communication with said hollow interior of said application roll;

said cylindrical porous distribution layer consisting of a first number of pores of a first predetermined pore size;

said porous flow control membrane consisting of a second number of pores having a second predetermined pore size no greater than said first predetermined pore size so that the flow of said sizing material distributed through said distribution layer is controlled by said membrane to meter a desired amount of sizing material onto said application surface;

actuator means for moving said application roll to an application position wherein said application roll contacts said pressure roll and warp yarn for pressing said predetermined amount of sizing material into said warp yarns passing therebetween, and for moving said application roll to an idle position wherein it is out of contact with said warp yarn sheet and said pressure roll;

surface conditioning means for maintaining said application surface of said application roll in a moist condition when moved to said idle position so that said sizing material does not dry in said pores while said application roll is in said idle position:

delivery means for delivering a pressurized sizing material to said hollow interior of said application roll in fluid flow contact with said flow control membrane in response to said warp yarns passing through the nip of said rolls, and for terminating said delivery of pressurized sizing material to said hollow interior of said application roll when said application roll is in said idle position so that said sizing material is not delivered onto said application surface during cessation of warp yarn passage.

2. The apparatus of claim 1 including means for removing excess moisture from said application surface of said application roll following movement of said application roll to said idle position and prior to said application roll being moved to said application position so that said sizing material is not diluted upon resumption of operation of said apparatus.

3. The apparatus of claim 1 wherein said surface conditioning means for maintaining said application surface in a moist condition comprises a source of liquid for contacting said application surface while said application roll is in said idle position.

4. The apparatus of claim 3 including removal means for removing excess liquid from said application surface prior to the resumption of said delivery of pressurized sizing material to said hollow interior of said application roll.

5. The apparatus of claim 3 wherein said surface conditioning means continuously applies said liquid to said cylindrical application surface around the entire circumference of said surface while said application roll is in said idle position.

6. The apparatus of claim 3 wherein said surface conditioning means for applying said liquid to said application surface includes a liquid applicator carried adjacent said application surface in said idle position, and auxiliary drive means for rotating said application roll at a reduced operating speed when said application roll is in said idle position to continuously engage said liquid applicator and said application surface.

7. The apparatus of claim 6 including elongated wiper means carried by said frame for contacting said rotating applicaton roll to remove excess liquid from said application surface prior to said application roll being returned to said application position.

8. The apparatus of claim 1 wherein said surface conditioning means comprises an elongated liquid applicator carried by said frame, means for moving said liquid applicator into contact with said application roll when in said idle position, and means for applying a liquid to said liquid applicator to therby moisten said application surface during contact.

9. The apparatus of claim 8 including a liquid reservoir, said liquid applicator being carried in liquid contact with said reservoir.

10. Apparatus for applying a sizing material to individual warp yarns passing between a pressure roll and an application roll wherein said yarns are arranged generally side by side in a warp sheet and a metered amount of sizing material is pressed into said warp yarns wherein said application roll is driven by a drive means and includes a hollow interior, a continuous cylindrical application surface formed on the outside surface of said application roll having an extent for applying sizing material generally across the entire width of said warp yarn sheet passing through a nip of said rolls; a cylindrical porous distribution layer next adjacent said application surface for distributing said sizing material onto said application surface; a porous flow control membrane carried adjacent an interior boundary region of said distribution layer in fluid communication with said hollow interior of said application roll; said porous membrane including porous material having a pore size substantially smaller than the pore size of the porous material of said distribution layer to meter the flow of sizing material through said distribution layer and onto said application surface; delivery means for delivering a pressurized sizing material into said hollow interior of said application roll in fluid flow communication with said flow control membrane while warp yarns are passing through the nip of said rolls and said apparatus.

11. The apparatus of claim 10 wherein said application surface of said application roll includes a porous surface having the same porous construction as said porous distribution layer to provide a fine continuous porous surface for application of said sizing material.

12. The apparatus of claim 10 wherein said application surface includes a pattern surface having cells which are larger than said pores of said distribution layer and collect and hold a larger volume of sizing material than said pores of said porous distribution layer.

13. The apparatus of claim 10 including actuator means for moving said application roll between an application position in which said sizing material is applied to said warp yarns by said application surface and an idle position in which said application roll is out of contact with said warp yarn sheet and said pressure roll; and surface conditioning means for preventing said sizing material from drying in said pores of said application surface while said application roll is out of contact with said warp yarn sheet.

14. The apparatus of claim 13 wherein said delivery means reduces the volume and pressure of said sizing material delivered to said hollow interior of said application roll while said application roll is in said idle position so that liquid sizing is not metered and distributed onto said application surface while in said idle position.

15. The apparatus of claim 13 wherein said surface conditioning means includes liquid contact means for contacting said application surface and moistening said application surface while said application roll is in said idle position; and auxiliary drive means for rotating said application roll contacting said liquid contact means.

16. The apparatus of claim 15 including liquid removal means for removing the excess liquid from said application surface prior to being returned to said application position.

17. The apparatus of claim 15 wherein said liquid contact means includes an elongated liquid applicator for contacting said application surface; elongated wiper means for contacting said application surface and removing any excess liquid to prevent the application of diluted sizing material onto said warp yarns upon return of said application roll to said application position and of said warp yarn passage through said nip of said rolls.

* * * * *